US009889057B1

(12) United States Patent
Womack

(10) Patent No.: US 9,889,057 B1
(45) Date of Patent: Feb. 13, 2018

(54) RETRACTABLE HANDLE SYSTEM FOR A CASKET

(71) Applicant: LaVerl A. Womack, Rigby, ID (US)

(72) Inventor: LaVerl A. Womack, Rigby, ID (US)

( * ) Notice: Subject to any disclaimer, the term of this patent is extended or adjusted under 35 U.S.C. 154(b) by 0 days.

(21) Appl. No.: 15/464,183

(22) Filed: Mar. 20, 2017

Related U.S. Application Data

(63) Continuation of application No. 15/440,097, filed on Feb. 23, 2017.

(51) Int. Cl.
*A61G 17/04* (2006.01)

(52) U.S. Cl.
CPC ..... *A61G 17/041* (2016.11)

(58) Field of Classification Search
CPC ..... A61G 17/00; A61G 17/04; A61G 17/041; A47B 95/02; B65G 7/12; Y10T 16/4701; Y10T 16/473
USPC ..... 27/2, 27, 35; 16/424, 429; 224/157; 294/15
See application file for complete search history.

(56) References Cited

U.S. PATENT DOCUMENTS 737,580 A * 9/1903 Babbitt ..... A61G 17/04 27/27
878,985 A * 2/1908 Montross ..... A61G 17/04 27/27
906,363 A * 12/1908 Babbitt ..... B25G 1/04 16/429
937,086 A * 10/1909 Montross ..... A61G 17/04 16/424
2,759,239 A * 8/1956 Snyder ..... A61G 19/00 27/27
2,802,253 A * 8/1957 Birck ..... A61G 19/00 27/27
D218,890 S * 10/1970 Kreminski ..... 27/27
3,844,003 A * 10/1974 Angermann ..... A61G 17/04 16/439
4,146,948 A * 4/1979 Royce ..... A61G 17/00 217/12 R
4,315,354 A * 2/1982 Behrendt ..... A61G 19/00 27/27
5,586,376 A * 12/1996 Enneking ..... A61G 19/00 27/27
7,921,528 B2 * 4/2011 Elhaj ..... A61G 17/00 27/12

(Continued)

OTHER PUBLICATIONS

Web page download, Jan. 29, 2011, Lumberjocks website: http://lumberjocks.com/projects/43508, 4 pages, accessed on Jul. 18, 2017.

*Primary Examiner* — William L Miller
(74) *Attorney, Agent, or Firm* — Schmeiser, Olsen & Watts LLP

(57) ABSTRACT

Disclosed is a retractable handle system for a casket. A casket having retractable handles includes a casket box with a casket lid openably coupled to it. A base is coupled to the casket box. The base includes a panel having a length and a width similar to the length and width of the casket box. Spacers are coupled to the panel to form channels. Arms are slidably located in the channels. At least four bars are coupled to the arms. The bars may have forty-five degree angled ends which allow the bars to abut each other when they are in a closed position causing them to no longer appear as handles on the casket box. Sliding the arms causes the bars to move from the closed to open position.

20 Claims, 17 Drawing Sheets

(56) References Cited

U.S. PATENT DOCUMENTS

| | | | | |
|---|---|---|---|---|
| 8,112,851 | B1 * | 2/2012 | Hughes | A61G 17/04 16/429 |
| 2013/0174378 | A1 * | 7/2013 | Davis | A61G 19/00 16/429 |
| 2016/0228318 | A1 * | 8/2016 | Hoijng | A61G 17/02 |

* cited by examiner

RETRACTABLE HANDLE SYSTEM FOR A CASKET

CROSS-REFERENCE TO RELATED APPLICATION

The present application is a continuation of U.S. patent application Ser. No. 15/440,097, entitled "RETRACTABLE HANDLE SYSTEM FOR A CASKET", filed Feb. 23, 2017, the relevant portions of said application is incorporated herein by reference.

BACKGROUND OF THE INVENTION

Technical Field

This invention relates to a retractable handle system for use with a casket or coffin.

State of the Art

Caskets or coffins are used to hold the bodies of the dead for burial. Often caskets are placed on display prior to burial. Caskets may be on display during a viewing or a funeral. Caskets may be displayed with their lids open or closed.

Families of the individual being buried may have difficulty finding a casket that reflects who the individual was. Therefore, it is often desirable to personalize the coffin for the specific person being buried. Traditional caskets are not always amenable to personalization as they are typically predecorated or have handles or other hardware in locations that make it difficult to personalize the casket.

Personalization of a casket may involve any type of decoration. Caskets may be personalized to reflect an individual's interests such as trains, planes, cars, hunting, fishing, the outdoors, princesses, ice skating, dolls, photography, animals or the like. Additionally, personalization may include the individual's name, family pictures or even a replication of the individual's tattoos.

Caskets may also be difficult to move around and fit through narrow openings as they often have handles or other hardware extending from the surfaces. Additionally, handles and other hardware require extra space in mausoleums or vaults which may hold the casket after burial.

Therefore it is desirable to have a casket with retractable handles which move from a closed to an open position and allow the casket to take up less space during moving and burial.

It is also desirable to have a casket that has handles that when retracted no longer look like handles and therefore allow personalization of the casket.

While there are caskets that have retractable handles, such as those described in Babbitt, U.S. Pat. No. 906,363; Angermann, U.S. Pat. No. 3,844,003; Enneking et al., U.S. Pat. No. 5,586,376; Elhaj, U.S. Pat. No. 7,921,528; Hughes, U.S. Pat. No. 8,112,851; Davis et al., U.S. Patent Publication No. 2013/0174378; and Hoijng, U.S. Patent Publication No. 2016/0228318. Very few of these references disclose handles that when retracted no longer look like handles. The references that do, have handles that are in locations that prevent personalization of the casket as personalization would likely interfere with the functioning of the handles.

Accordingly, an invention is needed to provide a casket with handles that retract in order to allow the casket to take up less space and which has handles that when retracted no longer appear to be handles in order to allow personalization of the casket. Additionally, retractable handles that retract in a way that personalization will not interfere with the functioning of the handles is also needed.

SUMMARY OF EMBODIMENTS

The present invention discloses a retractable handle system for use with a casket.

Disclosed is a handle system for use on a casket, the handle system includes at least one bar and at least two arms coupled to the at least one bar. At least one spacer is between the at least two arms, wherein the at least two arms slide horizontally adjacent the spacer causing the at least one bar to retract to a closed position. A top panel is located adjacent the at least one spacer. A bottom panel is also located adjacent the at least one spacer.

Alternate embodiments may include a casket with retractable handles including a casket box and a casket lid openably coupled to the casket box. At least one handle coupled to a bottom of the casket box. Wherein the at least one handle includes a bar, and at least two arms coupled to the bar, wherein the at least two arms are horizontally slidable from a closed location to an open location. A spacer is between the at least two arms. At least one panel abuts the spacer. Wherein the at least one panel and the spacer form a solid casket base with channels for the at least two arms to slide in.

In some embodiments, a casket having retractable handles includes a casket box with a casket lid openably coupled to the casket box. A base is coupled to the casket box. Wherein the base includes, at least one panel comprising a panel length and a panel width, wherein the panel length is between half a length of the casket box and a full length of the casket box and the panel width has a width between half a width of the casket box and a full width of the casket box. At least one spacer is coupled to the at least one panel, wherein the at least one spacer and the at least one panel form channels. A plurality of arms are slidably located in the channels. At least four bars are coupled to the plurality of arms. Wherein sliding the plurality of arms in the channels causes the four bars to move from the closed position to an open position.

Additional embodiments of a handle system for use on a casket may include a bottom panel and a plurality of spacers coupled to and abutting the bottom panel, wherein the plurality of spacers and the bottom panel form at least one channel. At least one arm is slidably located in the at least one channel. At least one bar may be coupled to the at least one arm, wherein the at least one arm slides horizontally adjacent at least one of the plurality of spacers causing the at least one bar to retract to a closed position. A top panel may be coupled to and abut the plurality of spacers, wherein the bottom panel, the plurality of spacers and the top panel form a mostly solid panel.

Other embodiments of a casket with retractable handles may include a casket box, a casket lid openably coupled to the casket box and a handle system coupled adjacent to a bottom of the casket box. The handle system may include at least one bar, and at least two arms coupled to the at least one bar. The at least two arms may be horizontally slidable from a closed location to an open location. A spacer may be between the at least two arms with at least one panel abutting the spacer, wherein the at least one panel and the spacer form a mostly solid panel with channels substantially the same width as the at least two arms for the at least two arms to slide in.

Further embodiments of a casket having retractable handles may include a casket box, a casket lid openably coupled to the casket box; and a base coupled adjacent to a bottom of the casket box. The base may include at least one panel comprising a panel length and a panel width, wherein the panel length is between half a length of the casket box and a full length of the casket box and the panel width has a width between half a width of the casket box and a full width of the casket box. At least one spacer may be coupled to the at least one panel, wherein the at least one spacer and the at least one panel form channels. A plurality of arms may be slidably located in the channels, wherein a width of the channels are substantially the same as a width of the plurality of arms. At least four bars may be coupled to the plurality of arms, wherein sliding the plurality of arms in the channels causes the at least four bars to move from a closed position to an open position.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
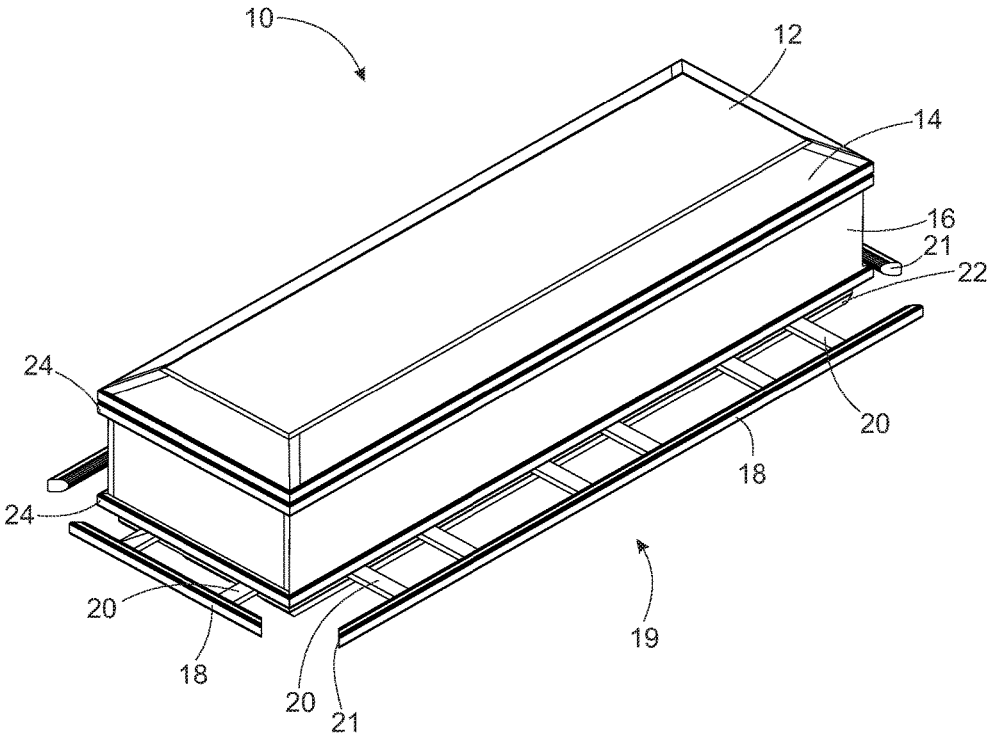
FIG. 1 is a top isometric view of a casket with retractable handles in an open position.

Embodiments of this invention disclose a retractable handle system for use on a casket. The retractable handle system includes handles that may be retracted to a closed position adjacent the casket. When the handles are in the closed position, the handles may appear to be trim on the casket. In alternate embodiments, the handles are flush with the sides of the casket and therefore no longer appear to be handles. However, when the handles are needed for use, they may be pulled to an open position so that they may be used to carry the casket from one location to another.

It is to be understood that some of the terms used herein to disclose the elements and various embodiments of the present invention may have broad meaning according to at least the definitions provided herein below. "Casket" means a rectangular box often with a split lid which is used for burying the dead. "Coffin" means a box for burying the dead. Typically a "Coffin" is hexagonal in shape. While the definitions of "Casket" and "Coffin" are different, the words will be used interchangeably to describe a box for burying the dead regardless of shape. "Hardware" is the ornamental fixtures and fittings that are coupled to the outside of a casket or coffin. Typical "Hardware" includes handles and corners. "Handles" are the hardware coupled to the outside of a casket that are designed to allow the casket to be lifted by hand. "Handles" are typically used by pall bearers to move the casket from one location to another. "Handles" comprise a "Bar" and "Arms". The "Bar" of a handle is the portion that is held in the hand. On caskets, the "Bar" is typically a bar that is coupled to the casket for lifting. "Bars" may run the entire length of the casket or multiple shorter "Bars" may be coupled along the casket as distinct handles. The "Arm" of a handle is the portion that extends from the "Bar" to the side of the casket. "Bars" are typically coupled to a casket by at least two "Arms".

FIGS. 1-11 illustrate a casket with retractable handles 10. In particular, FIGS. 1-6 illustrate a casket with retractable handles 10 in an open position, while FIGS. 7-11 illustrate a casket with retractable handles 10 in a closed position.

A casket with retractable handles 10 as illustrated in the figures includes a casket 12 having a casket box 16 and a casket lid 14. The casket 12 illustrated is a rectangular casket 12 with a single piece casket lid 14. The casket lid 14 may be completely removable from the casket box 16 or the casket lid 14 may be hingedly coupled to the casket box 16.

Though illustrated as a rectangular casket 12, the casket 12 may also be a hexagonal coffin. The casket 12 may have rounded edges. The casket 12 may also narrow or widen at different portions as desired. The casket 12 may be any shape desired which serves the purpose of holding a body for burial.

The casket 12 may be formed from metal, wood, green materials, glass or the like. The casket 12 may also be formed from a mixture of materials. The casket 12 may be formed from any material which is strong enough to hold a body for transportation.

The casket lid 14 may be a single piece as illustrated or the casket lid 14 may have a split lid. A split lid is a lid that opens in two separate sections. Typically split lids are used for caskets 12 which will be displayed at viewings or funerals. Split lids allow the top of the casket lid 14 to be opened to display the head and upper torso of the deceased, while the bottom half of the lid 14 remains closed.

The casket lid 14 may be completely removable from the casket box 16 or the casket lid 14 may be hingedly coupled to the casket box 16.

The casket lid 14 may be flat or angled as illustrated in the figures. Additionally, the casket lid 14 may be arched, curved or the like.

The casket box 16 is the portion of the casket 12 in which the body is held. The casket box 16 must be deep enough, wide enough and long enough to allow a body to be easily placed inside. The casket box 16 is also often lined with satin, fabric or the like depending on the desires of the customer. The casket may also contain padding or other objects that allow the body to be placed in a position which appears comfortable to those viewing the body in the coffin.

The casket box 16 may be rectangular as illustrated or else the casket box 16 may be rounded, circular, curved or the like. The casket box 16 may be any shape that allows a body to be placed in the casket box 16.

The casket 12 and the casket box 16 may also contain other features that are typical in caskets 12. The casket 12 may contain a drawer or other hidden location in which personal effects of the deceased may be stored. The casket 12 may also have latches or other devices for securing the lid 14 in place for burial.

Additionally, caskets 12 may also include gaskets and other methods of sealing the casket 12 to dirt and moisture.

The casket 12 may be decorated with trim 24. The trim 24 may be any decoration applied to the outside of the casket 12. Typically, trim 24 is a linear ornamentation or decoration that protrudes from the surface of the casket 12. The trim 24 is a raised area on the casket 12 that increases the visual appeal of the casket 12.

Trim 24 is typically applied around the bottom and top of the casket box 16 and around the edge of the lid 14. Trim 24, however, may be placed in any location on the casket 12.

Trim 24 may be formed from the same material as the casket 12 such as wood or metal, or the trim 24 may be formed from a different material in order to provide a contrast.

In alternate embodiments, it may be desirable for a casket 12 to not include trim 24 or to include minimal trim 24. Trim 24 may sometimes interfere with or detract from personalization of the casket 12. Additionally, some customers do not like the look of trim 24.

The casket box 16 is coupled to a casket base 22. The casket base 22 is located at the very bottom of the casket 12 under the casket box 16. The casket base 22 provides support to the casket box 16. Additionally, the casket base 22 contains the retractable handles 19.

The retractable handles 19, as illustrated in the figures, comprise a bar 18. The bar 18 is a linear member which is the same length or a similar length to that of the casket 12. The bar 18, however, could be a series of shorter bars 18 placed adjacent each other or spaced along the edge of the casket 12.

The bar 18 may be any shape desired. The bar 18 is illustrated as resembling the trim 24 on the casket 12 in order to allow the bar 18 to be camouflaged when the handle 19 is in the closed position. The outside surface of the bar 18 may have a shape of the trim 24 on the casket 12, while the other surface of the bar 18 may be any shape desired which makes the bar 18 easier to use as a handle. Therefore, the surface of the bar 18 closest to the casket 12 may be rounded or the like.

In alternate embodiments, the bar 18 may also resemble the sides of the casket 12. In these embodiments, the bar 18 may have a flat smooth outer surface. When the retractable handles 19 are in a closed position, the bar 18 is flush with the outer surface of the casket 12 and blends in with the surface. The retractable handles 19 are located along all four sides of the casket 12. Therefore all four sides of the casket 12 have a bar 18 that runs the length of the casket 12 side.

In alternate embodiments, multiple bars 18 may be located along each of the four sides of the casket 12.

Each bar 18 may have an angle 21 formed in each of the ends of the bar 18. The angles 21 formed in the ends of the bars 18, as illustrated, are 45 degree angles which allow all of the bars 18 to abut each other without the bars 18 interfering with each other and without gaps between the bars 18.

In embodiments with caskets 12 of other shapes or sizes, the angle 21 formed in the end of the bars 18 may be different in order to allow the bars 18 to be disguised as trim 24 when the retractable handles 19 are in the closed position.

In alternate embodiments of a casket with retractable handles 10, the bars 18 may not have an angle 21 formed at their ends. Instead, the ends of the bars 18 may have a flat end which abuts a corner piece when the retractable handles 19 are in a closed position.

The retractable handles 19 also comprise at least one arm 20. The arms 20 are linear members that connect the bar 18 to the casket base 22. The arms 20 may be any size or shape that allows the arms 20 to support the bar 18 when the handles 19 are in use.

Figure 2:
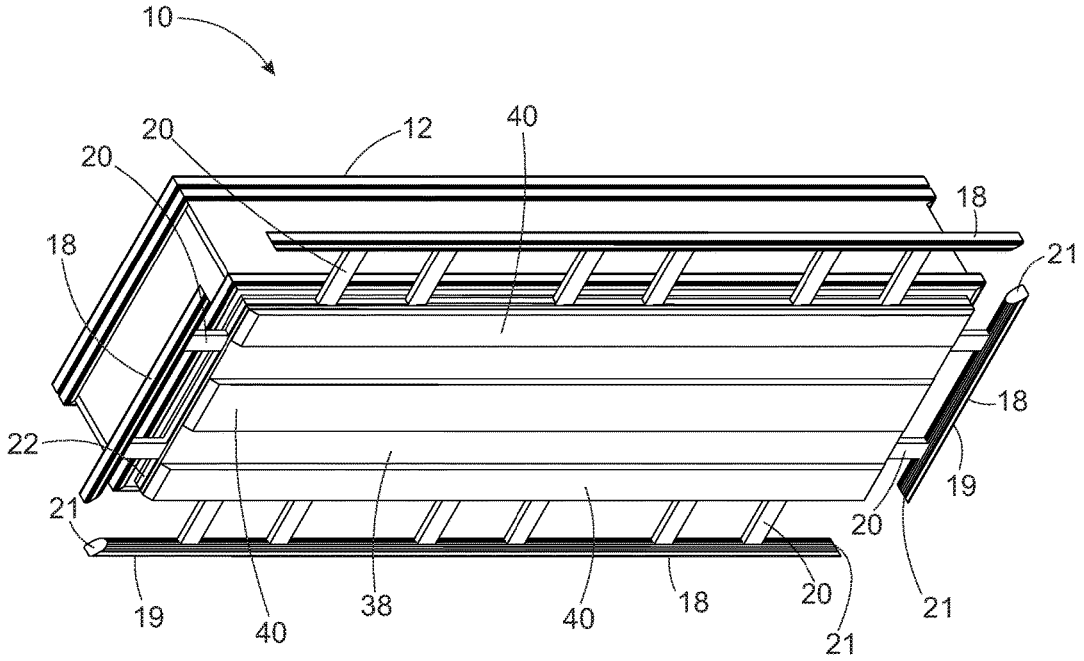
FIG. 2 is a bottom isometric view of a casket with retractable handles in an open position.
Figure 3:
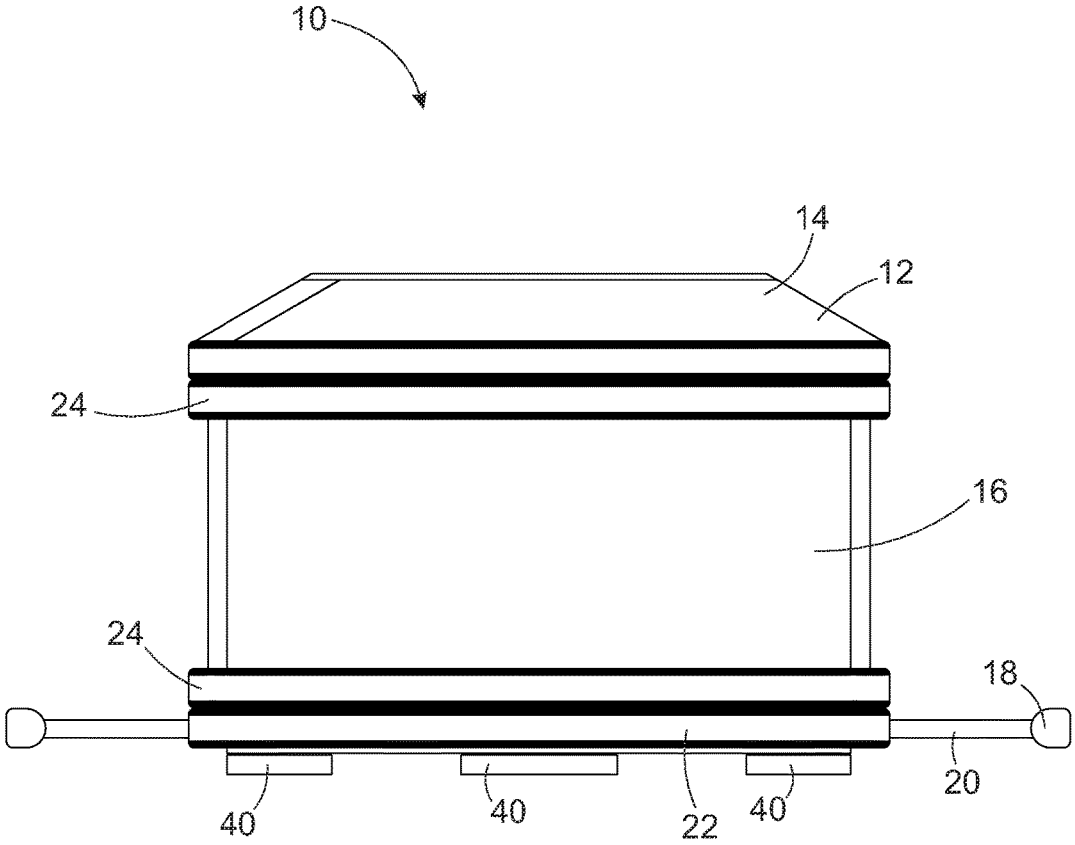
FIG. 3 is an end view of a casket with retractable handles in an open position.
Figure 4:
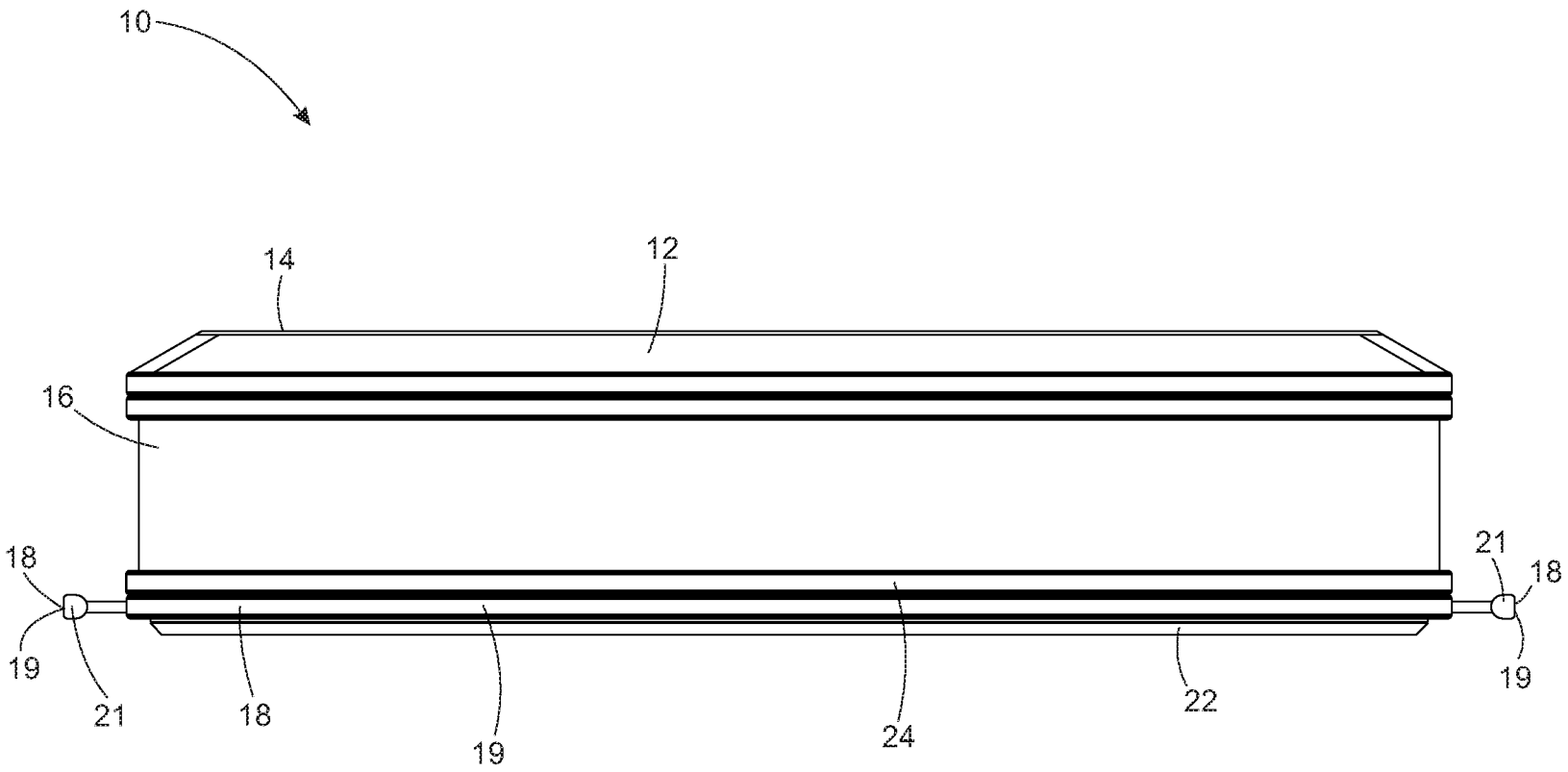
FIG. 4 is a side view of a casket with retractable handles in an open position.
Figure 5:
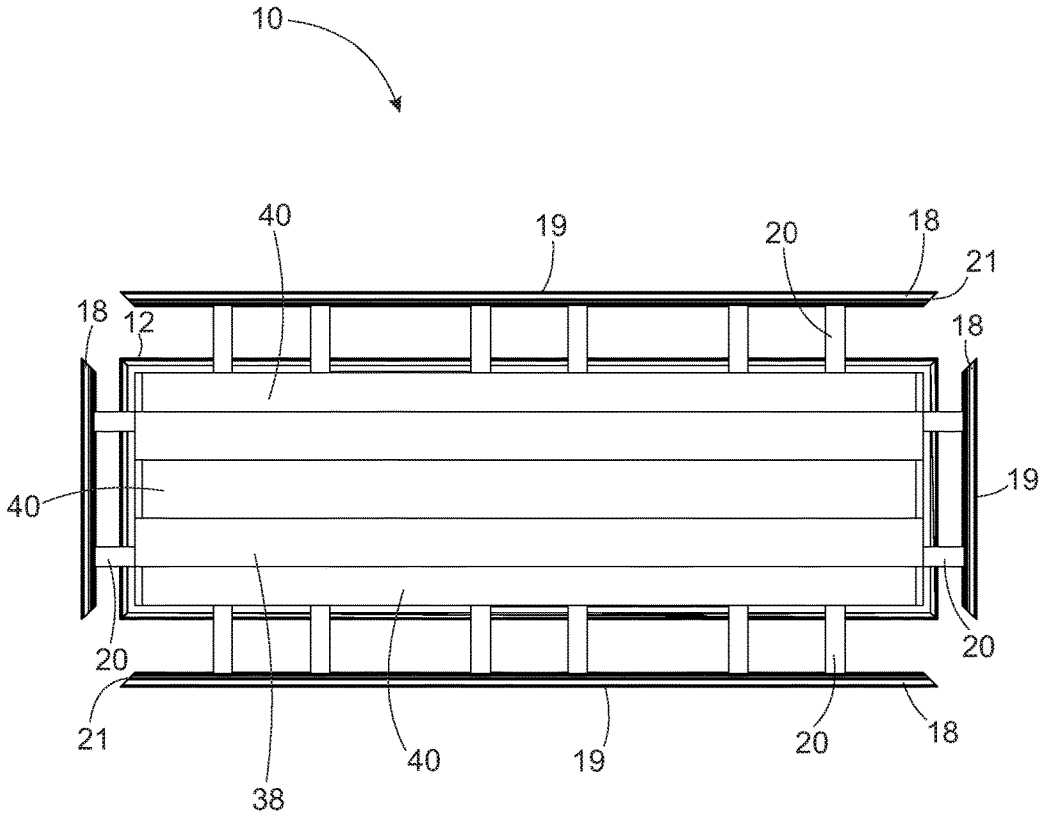
FIG. 5 is a bottom view of a casket with retractable handles in an open position.
Figure 6:
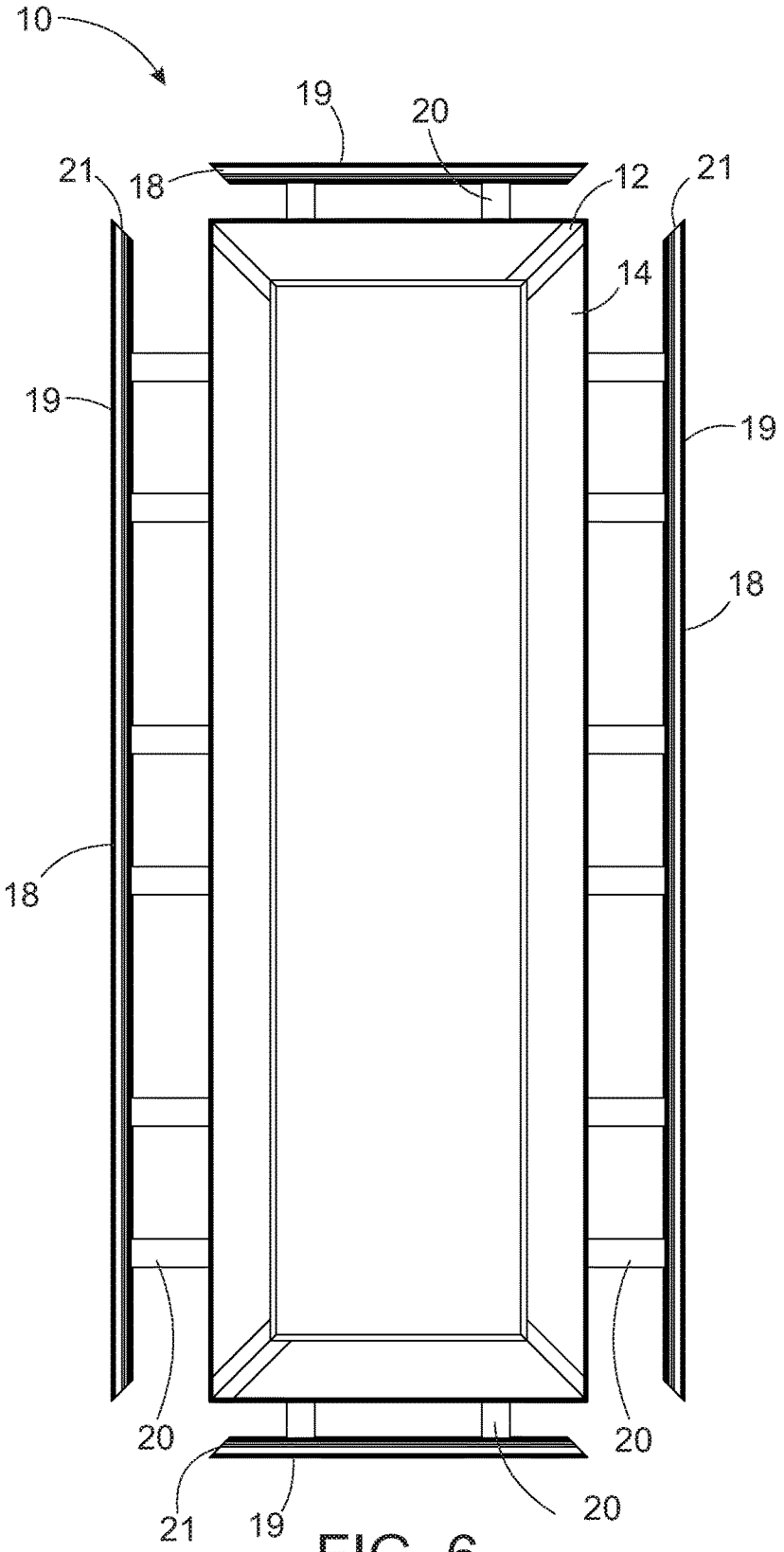
FIG. 6 is a top view of a casket with retractable handles in an open position.
Figure 7:
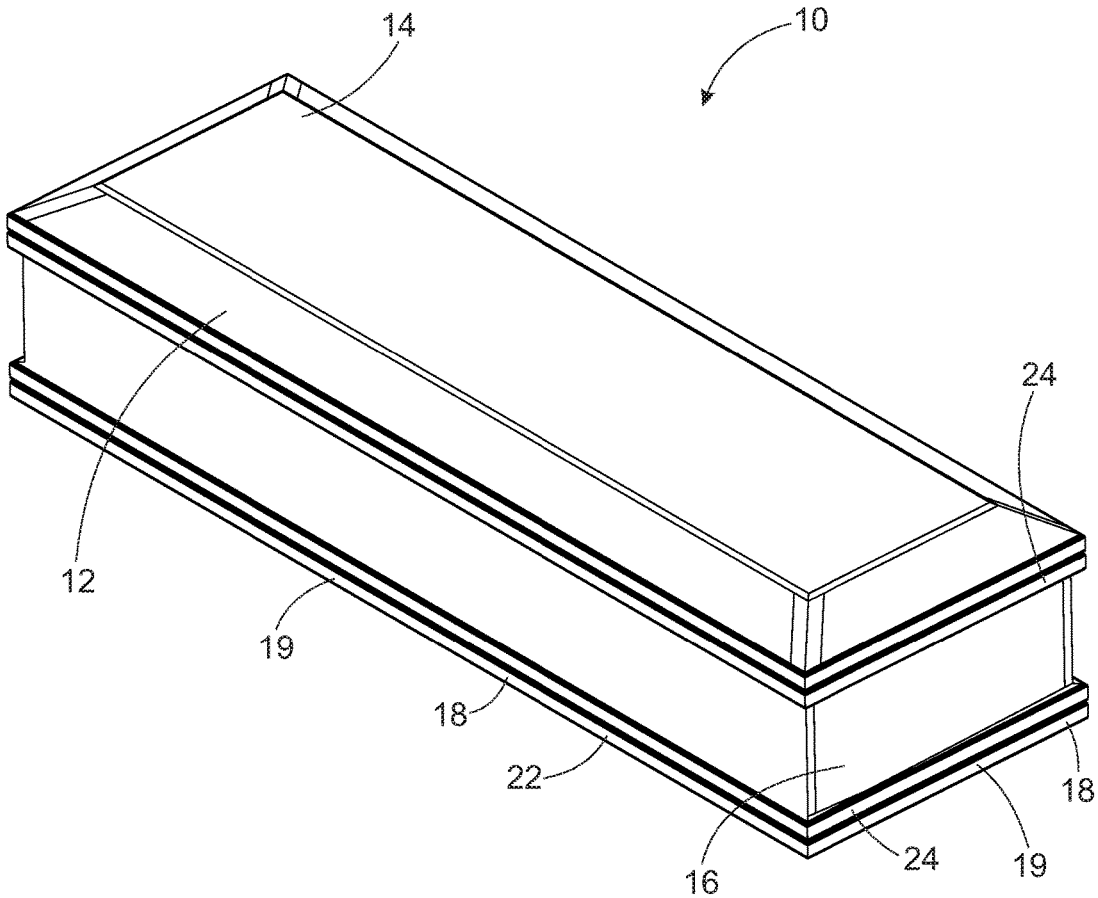
FIG. 7 is an isometric view of a casket with retractable handles in a closed position.
Figure 8:
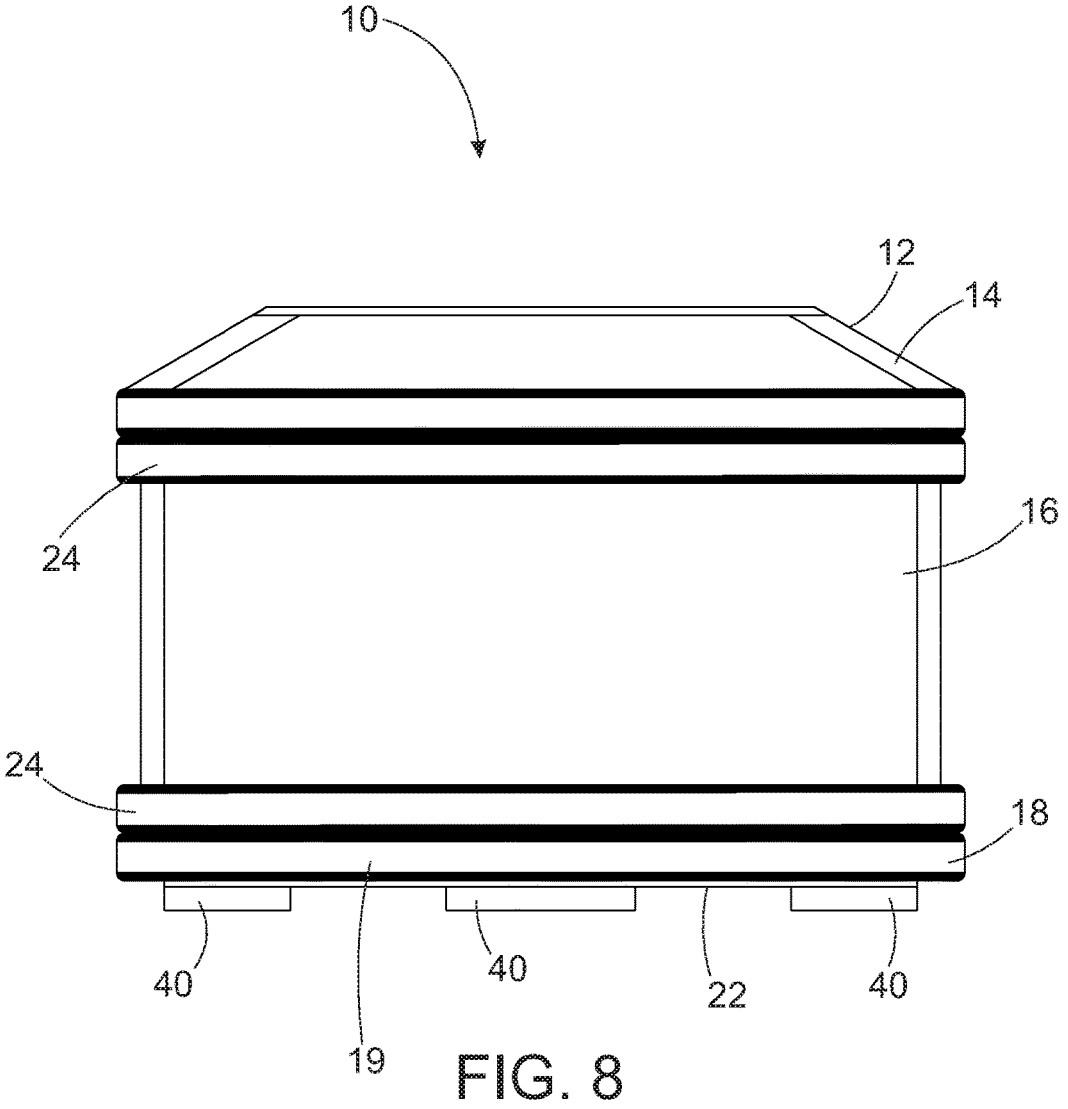
FIG. 8 is an end view of a casket with retractable handles in a closed position.
Figure 9:
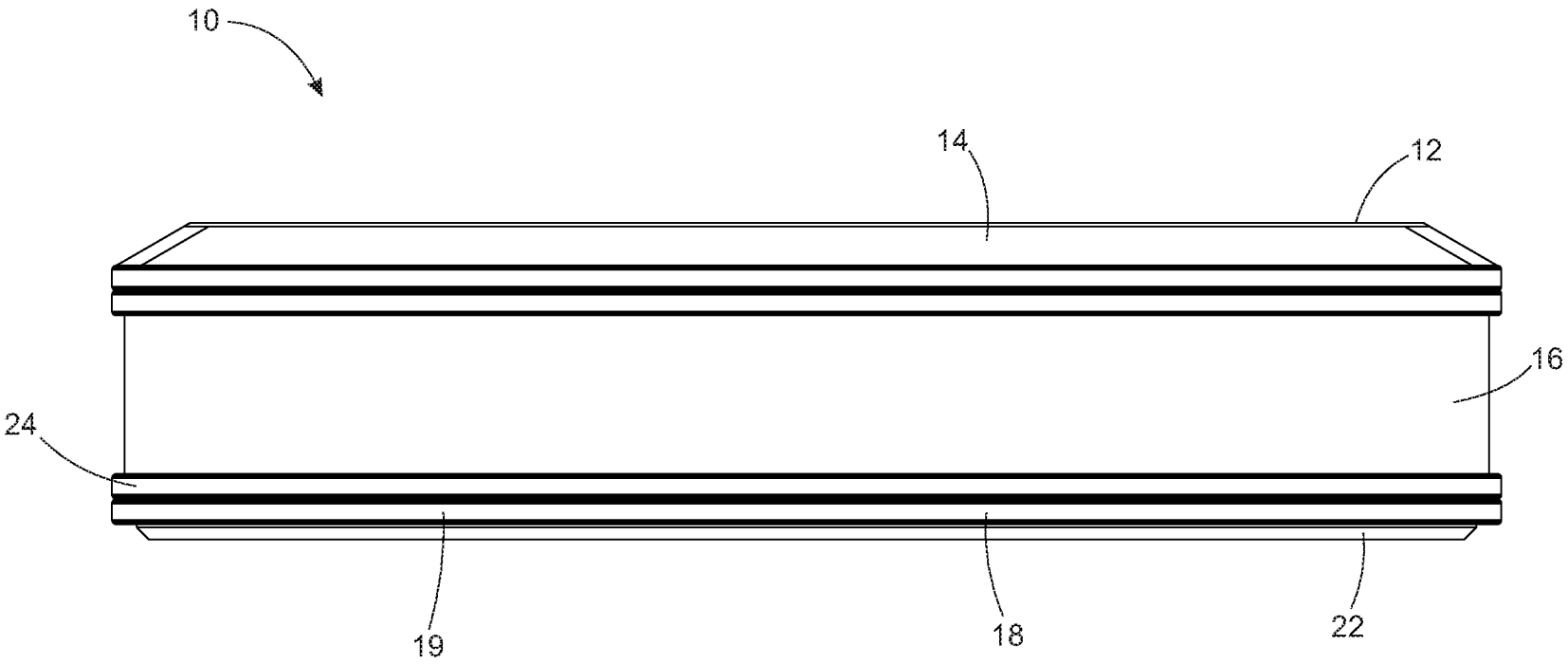
FIG. 9 is a side view of a casket with retractable handles in a closed position.
Figure 10:
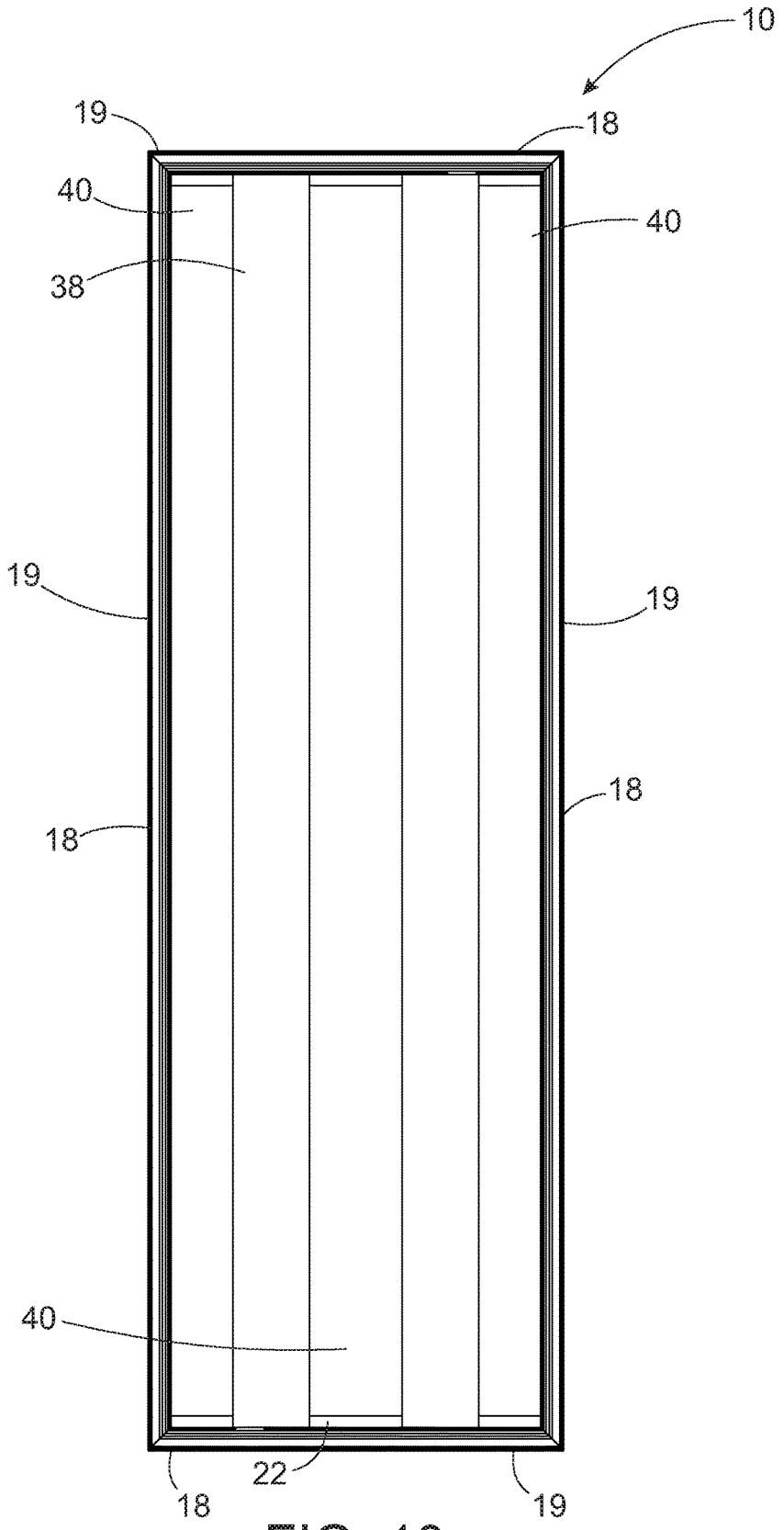
FIG. 10 is a bottom view of a casket with retractable handles in a closed position.
Figure 11:
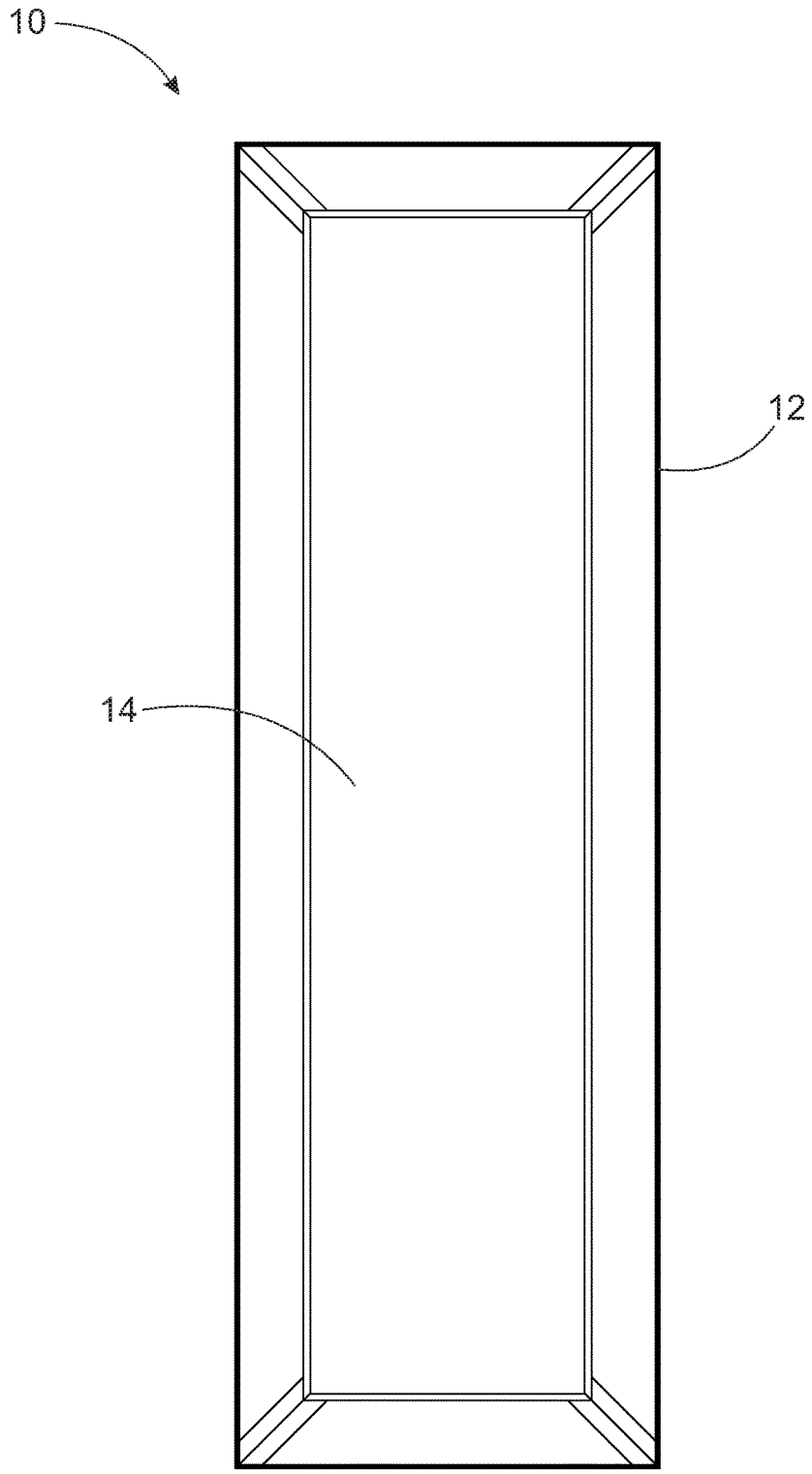
FIG. 11 is a top view of a casket with retractable handles in a closed position.

FIG. 2 illustrates a casket with retractable handles 10 from a bottom angle. This figure illustrates the bottom of the casket base 22. The bottom of the casket base 22 includes a bottom panel 38. The bottom panel 38 is a thin rectangular panel of material that is similar in size and shape to the bottom surface of the casket 12.

The bottom panel 38 may, however, be slightly smaller than the bottom of the casket 12 in order to allow clearance for the retractable handles 19. The bottom panel 38 may have a width between half the width of the casket 12 and the whole width of the casket 12. The bottom panel 38 may also have a length between half the length of the casket 12 and the whole length of the casket 12.

The bottom panel 38 adds support to the casket 12 and the casket base 22.

Along the lower surface of the bottom panel 38 are skids 40. Skids 40, as illustrated, are 3 rectangular members that are coupled to the bottom panel 38. Skids 40, however, may be any size or shape as desired. Additionally, there may be a fewer or greater number of skids 40 coupled to the bottom panel 38. The number of skids 40 may depend on the size of the casket 12 and the like.

The skids 40 provide clearance for the retractable handles 19. When the casket 12 is sitting on a table or a cart, the skids 40 provide clearance so that a user can place their fingers under the edge of the casket 12 in order to pull the handles 19 to an open position.

Additionally, when the casket 12 is placed on the casket lowering device which lowers the casket 12 into a grave, the skids 40 provide clearance to allow the retractable handles 19 to be moved to a closed position.

FIGS. 7-11 illustrate a casket with retractable handles 10 in a closed position. As illustrated in these figures, the retractable handles 19 appear to be trim 24 when they are in the closed position. This allows the casket 12 to be decorated with all types of artwork, photographs and the like.

Caskets 12 may be wrapped in vinyl wraps such as those used to decorate vehicles and the like. Vinyl wraps may be printed with any type of artwork, photographs or the like. The wrap is then applied to the casket 12 in order to personalize the casket 12 for the individual being buried. The wrap may also be applied to the bars 18 of the retractable handles 19 so that when the handles 19 are in the closed position, they blend in with the rest of the casket 12.

By placing the retractable handles 19 towards the bottom of the casket 12 and by allowing the handles 19 to appear as trim 24 in the closed position, the casket with retractable handles 10 can be easily personalized. Additionally, in embodiments where the handles 19 blend in with the sides of the casket 12, placing the retractable handles 19 towards the bottom of the casket 12 allow for easier personalization and reduce the chance that the retractable handles 19 will impede personalization.

Figure 12:
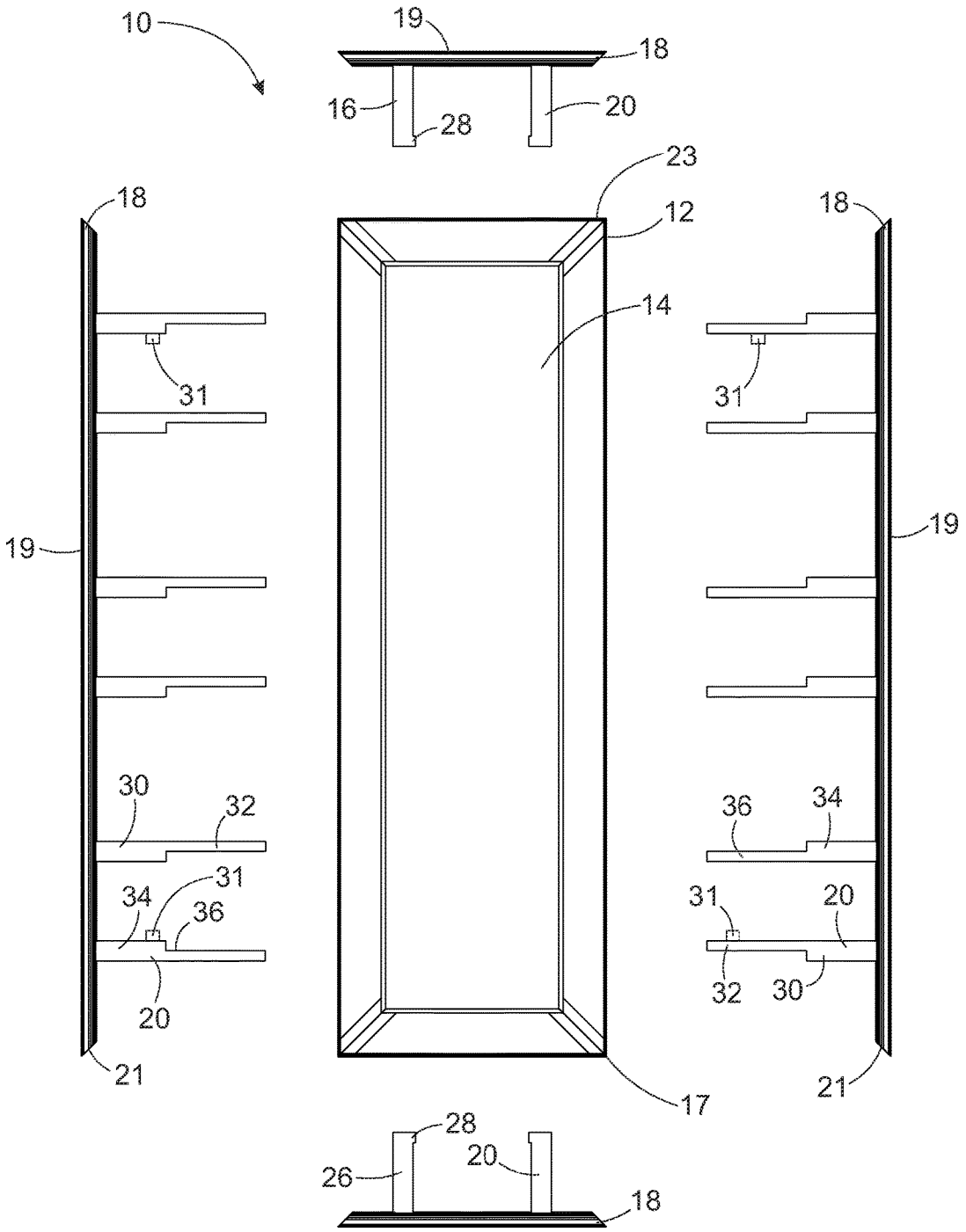
FIG. 12 is a top exploded view of a casket with retractable handles.

FIGS. 12-15 illustrate different exploded views of the casket base 22. FIG. 12 illustrates an exploded view of the casket with retractable handles 10 from the top.

Retractable handles 19, as discussed previously include a bar 18. The bar 18 is coupled to the casket base 22 through arms 20. When the retractable handles 19 are in an open position, the arms 20 appear to be simple rectangular members. When removed from the casket base 22, however, the arms 20 located along the long sides of the casket 12 have narrow portions 32 and 36 located at the ends farthest from the bar 18. Narrow portions 32 and 36 are portions or sections of the arms 20 where a rectangular portion of one side of the arm 20 have been removed. These narrow portions 32 and 36 allow the arms 20 from both sides of the casket 12 to pass each other without interfering in each other's motion.

In alternate embodiments of the retractable handles 19, the arms 20 do not pass each other as they slide from a closed position to an open position. Instead, the arms 20 are shorter than half the width of the casket 12 and therefore do not abut or interfere with each other. In these embodiments, the narrow portions 32 and 36 of the arms 20 are not needed.

Narrow portion 32 has a rectangular portion of the arm removed towards a proximal end 17 of the casket 12, while narrow portion 36 has a rectangular portion of the arm 20 removed on the side of the arm 20 located towards a distal end 23 of the casket 12.

The arm 20 on one side of the casket 12 is configured directly opposite to the arm 20 on the other side of the casket 12. Therefore, the arm 20 on a first side of the casket has the narrow portion 32 located towards the proximal end 17 (FIG. 12) of the casket 12, while the arm 20 on a second side of the casket 12 is configured with the narrow portion 36 located towards the distal end 23 of the casket 12.

When the retractable handles 19 are in the closed position, the narrow portions 32 and 36 of arms 20 on the opposite sides of the casket 12 overlap.

When the retractable handles 19 are in the open position, a wide portion 30 and 34 are the only portions of the arms 20 which are visible. The wide portions 30 and 34 of the arms 20 are located between the bar 18 and the narrow portions 32 and 36 of the arms. The wide portions 30 and 34 are illustrated as rectangular members.

On the retractable handles 19 located along the long sides of the casket 12, the arms closest to the proximal end 17 also include a stop 31. Stops 31 are small square or rectangular extensions located along the arms 20. The stops 31 interact with the casket base 22 and prevent the retractable handles 19 from pulling off of the casket 12 when the user is moving the retractable handles 19 from the closed position to the open position.

The arms 20 on the retractable handles 19 on the short sides of the casket 12 are configured slightly different from the arms 20 on the retractable handles 19 on the long sides of the casket 12. The arms 20 on the short sides of the casket 12 are simple rectangular members 26 with stops 28 formed at the end of each arm 20.

The stops 28 prevent the retractable handles 19 from pulling out of the casket base 22 when in use.

Figure 13:
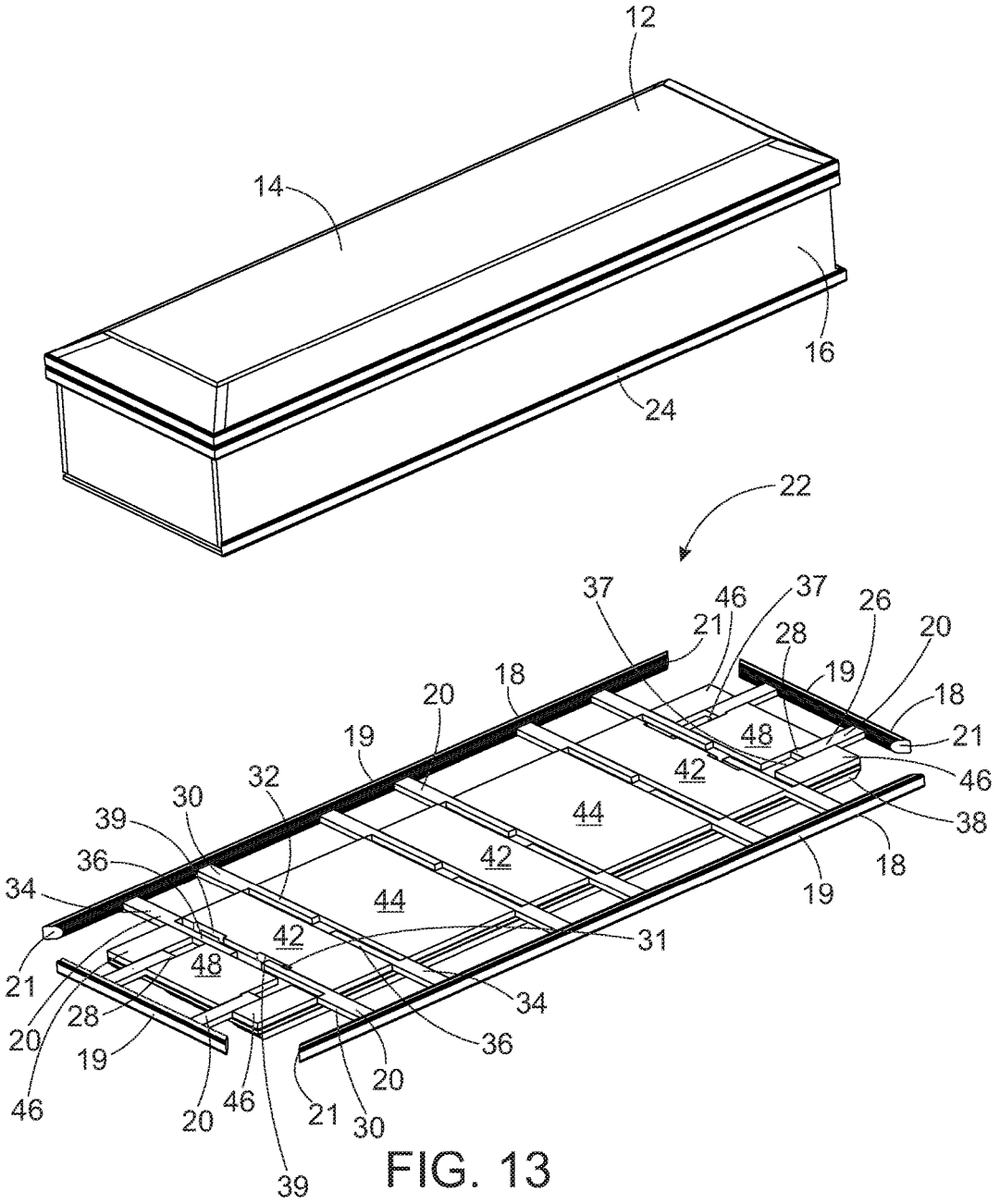
FIG. 13 is an isometric partially exploded view of a casket with retractable handles.

FIG. 13 illustrates a partially exploded view of a casket with retractable handles 10. In this figure, the casket box 16 and a top panel have been removed from the casket base 22.

Figure 14:
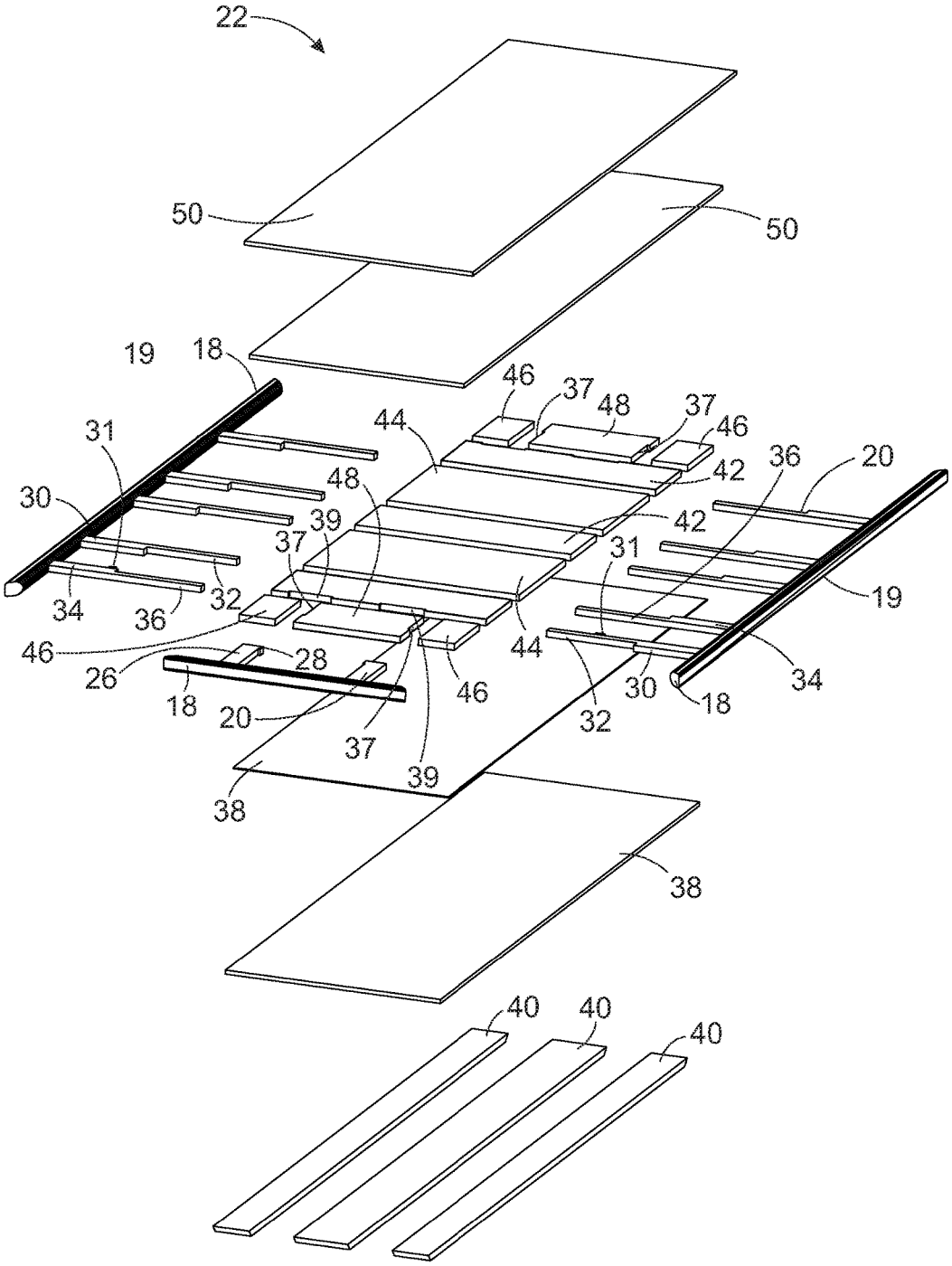
FIG. 14 is an isometric exploded view of a casket base with retractable handles.
Figure 15:
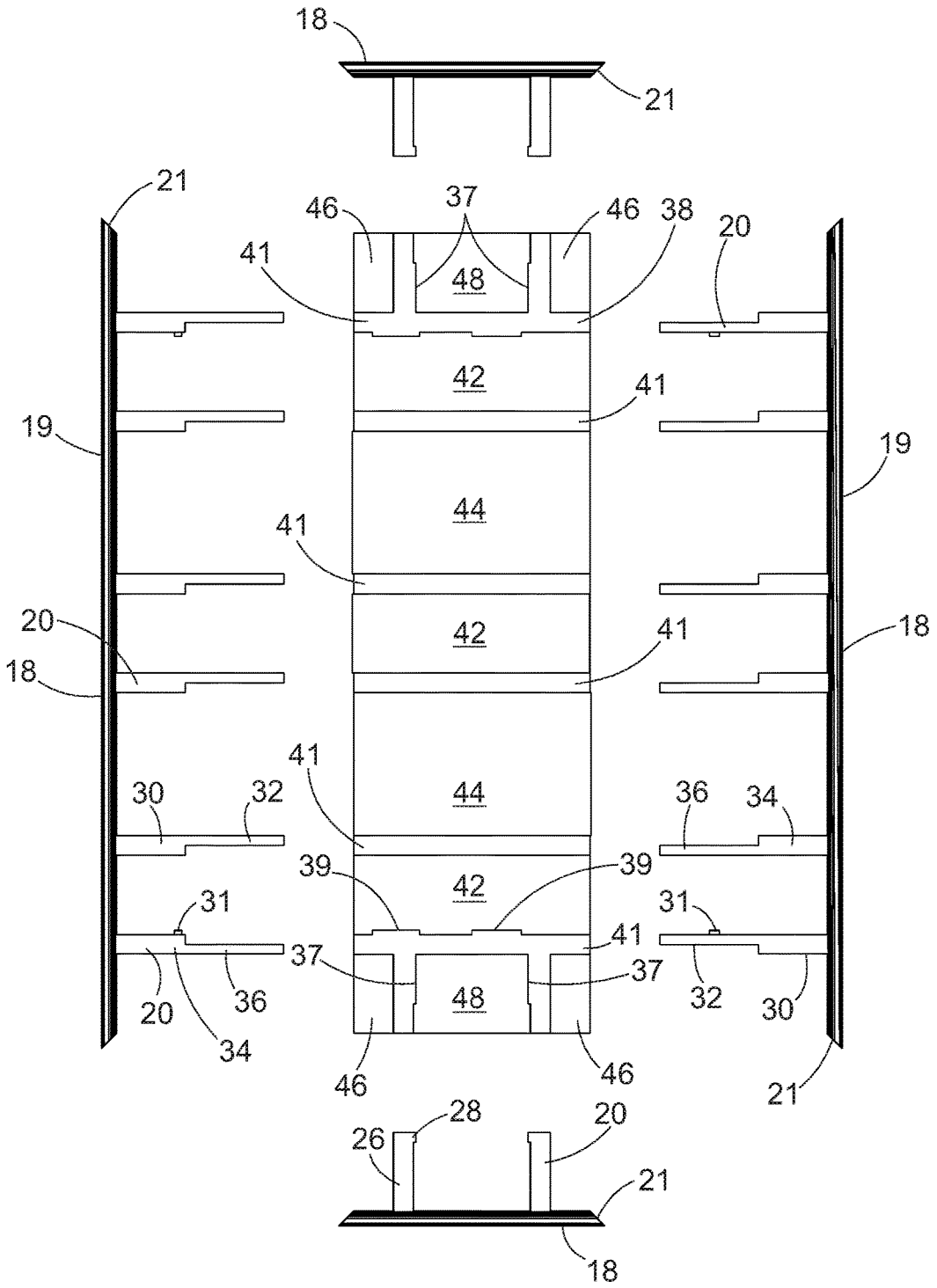
FIG. 15 is a top exploded view of a portion of a casket base with retractable handles.

FIGS. 14-15 illustrate exploded portions of the casket base 22. The casket base 22 is coupled to the bottom of the casket box 16 on a casket with retractable handles 10.

The top of the casket base 22 includes a top panel 50 (FIG. 14). The top panel 50 is a thin rectangular member which is approximately the same size and shape as the bottom of the casket box 16. The top panel 50 may be slightly smaller than the bottom of the casket box 16. The top panel 50 may have a width between half the width of the casket 12 and the whole width of the casket 12. The top panel 50 may also have a length between half the length of the casket 12 and the whole length of the casket 12.

The top of the casket base 22 which is coupled to the bottom of the casket box 16 may include two top panels 50. The top panels 50 as described above are thin rectangular panels which provide support and stability to the casket base 22.

The top panels 50 may be coupled together with adhesive, nails, screws, staples or the like. Additionally, the top panels 50 may be coupled to the casket box 16 with adhesive, nails, screws, staples or the like.

Though, illustrated as two separate panels, the top panels 50 may actually be one thicker panel or a panel of stronger material that provides the support and stability needed.

The bottom of the casket base 22 includes skids 40 as discussed previously. The skids 40 are coupled to the bottom panel 38. The skids 40 may be coupled to the bottom panel 38 through nails, screws, staples, adhesive or the like.

The bottom panel 38 as discussed previously is a thin rectangular panel that provides support and stability to the casket base and reduces friction for the retractable handle arms 22. As illustrated, there may be two bottom panels 38 coupled together for additional support.

The bottom panels 38 may be coupled together with adhesive, nails, screws or the like.

Though illustrated as two separate bottom panels 38, there may only be one bottom panel 38 which is thicker or stronger than the bottom panels 38 illustrated. In this case, a single bottom panel 38 may be adequate to provide the support required.

Spacers 42, 44, 46 and 48 are coupled to the top of the bottom panel 38. Spacers 42, 44, 46 and 48 are thin members of material that are coupled to the bottom panel 38 through adhesive, nails, screws, staples, brads, fasteners or the like. The spacers 42, 44, 46 and 48 create smooth channels 41 along the surface of the bottom panel 38. The channels 41 are substantially the same width or only slightly wider than the arms 20. The arms 20 of the retractable handles 19 move back and forth in these channels 41 as they are moved from an open position to a closed position and back again.

Spacers 42 are illustrated as narrower than spacers 44. However, all spacers may be the same width depending on the configuration of the arms 20.

One of spacers 42 located towards an end of the casket 12 may also include stop grooves 39. Stop grooves 39 are indentations formed in the edge of the spacer 42. The stop grooves 39 run a small portion of the total length of the spacer 42. Additionally, there are two stop grooves 39 formed on the edge of the spacer 42.

The stop grooves 39 receive the stops 31 coupled to the edges of two of the arms 20. The stop grooves 39 are designed to prevent the arms 20 from being pulled out of the channels 41 and therefore the retractable handles 19 pulled off of the casket 12. The stop grooves 39 also prevent the retractable handles 19 from being forced too far under the casket 12.

The stop grooves 39 prevent the retractable handles 19 from being pulled too far out by preventing the stop from travelling farther than the length of the stop groove 39. As the retractable handles 19 are moved from the closed position to the open position, the stop 31 travels the length of the stop groove 39. When the retractable handles 19 reach their fully open location, the stop 31 abuts the end of the stop groove 39 therefore preventing the retractable handles 19 from being pulled or from sliding out from under the casket 12.

Additionally, the stop 31 abuts the other end of the stop groove 39 when the retractable handles 19 are in their fully closed position.

Spacer 48 and 46 create channels 41 for the arms 20 of the retractable handles 19 located on the short or proximal 17 and distal 23 ends of the casket 12. Spacers 46 are small rectangular spacers that are coupled to the four corners of the bottom panel 38. Spacers 48 are rectangular members that are located between spacers 46 along the end edges of the bottom panel 38.

Spacers 48 also have indentations 37 along their shorter two edges. These indentations 37 receive stops 28 formed on the edges of the arms 26 on the retractable handles 19 at the shorter sides or width of the casket. The indentations 37 receive stops 28 in order to prevent retractable handles 19 from pulling or sliding out of the casket base 22.

As the retractable handles 19 are pulled from a closed position to an open location the stops 28 slide along the indentations 37 until they abut an end of the indentations 37. When the stops 28 abut an end of the indentations 37 the retractable handles 19 are in the fully open position and the retractable handles do not slide any farther from the casket 12.

When the arms 20 are in place in the channels 41 formed by spacers 42, 44, 46 and 48 and the top panels 50 are coupled in place to the top of spacers 42, 44, 46 and 48, the retractable handles 19 are prevented from moving up and down as the arms 20 of the retractable handles 19 are held in a horizontal plane by the top panels 50.

In order to use the casket with retractable handles 10, the casket 12 may be placed on a table or a cart. The skids 40 provide clearance for the user's fingers to slip under the edge of the casket 12. The user then pulls the retractable handles 19 by pulling on the bar 18. As the user pulls the retractable handles 19, the stops 31 and 28 move along the stop grooves 39 or indentations 37 until the stop 31 or 28 abuts an edge of the stop groove 39 or indentation 37. Once the stop 31 or 28 abuts an end of the stop groove 39 or indentation 37, the retractable handles 19 are in the fully open position.

The users must pull each of the retractable handles 19 to the fully open position individually.

The casket 12 may now be moved from one location to another by lifting on the bar 18 of the retractable handles 19.

Once the casket 12 is in the desired location, such as on the casket lowering device, the retractable handles 19 may be returned to the fully closed position by the user pushing the bar 18 back to a position adjacent the edge of the casket.

Though illustrated as part of the casket 12, in alternate embodiments, the casket base 22 may be removable. Additionally, the casket base 22 may be attached to preexisting caskets 12 in order to give the casket 12 retractable handles.

Figure 16:
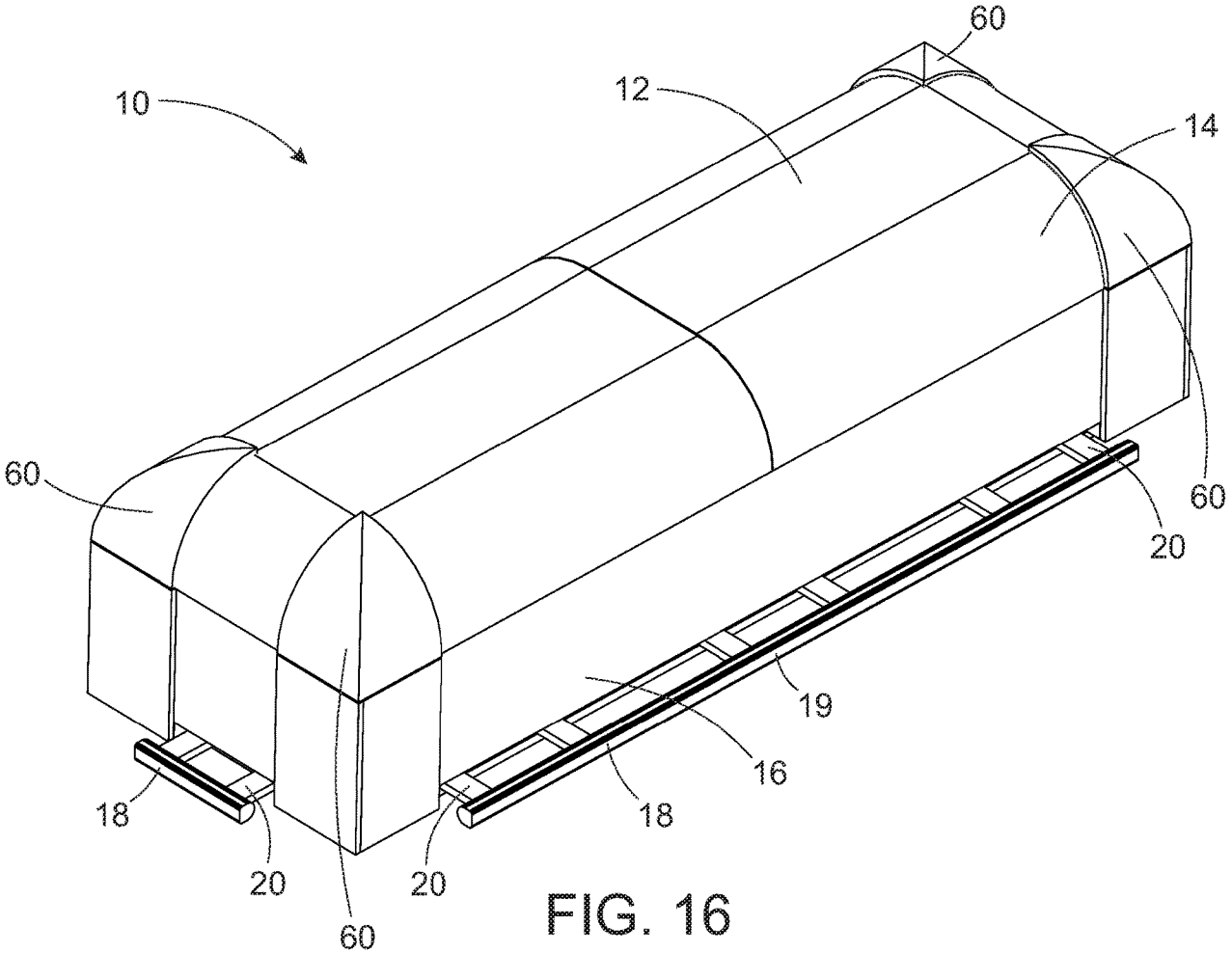
FIG. 16 is an isometric view of an alternate embodiment of a casket with retractable handles in an open position.
Figure 17:
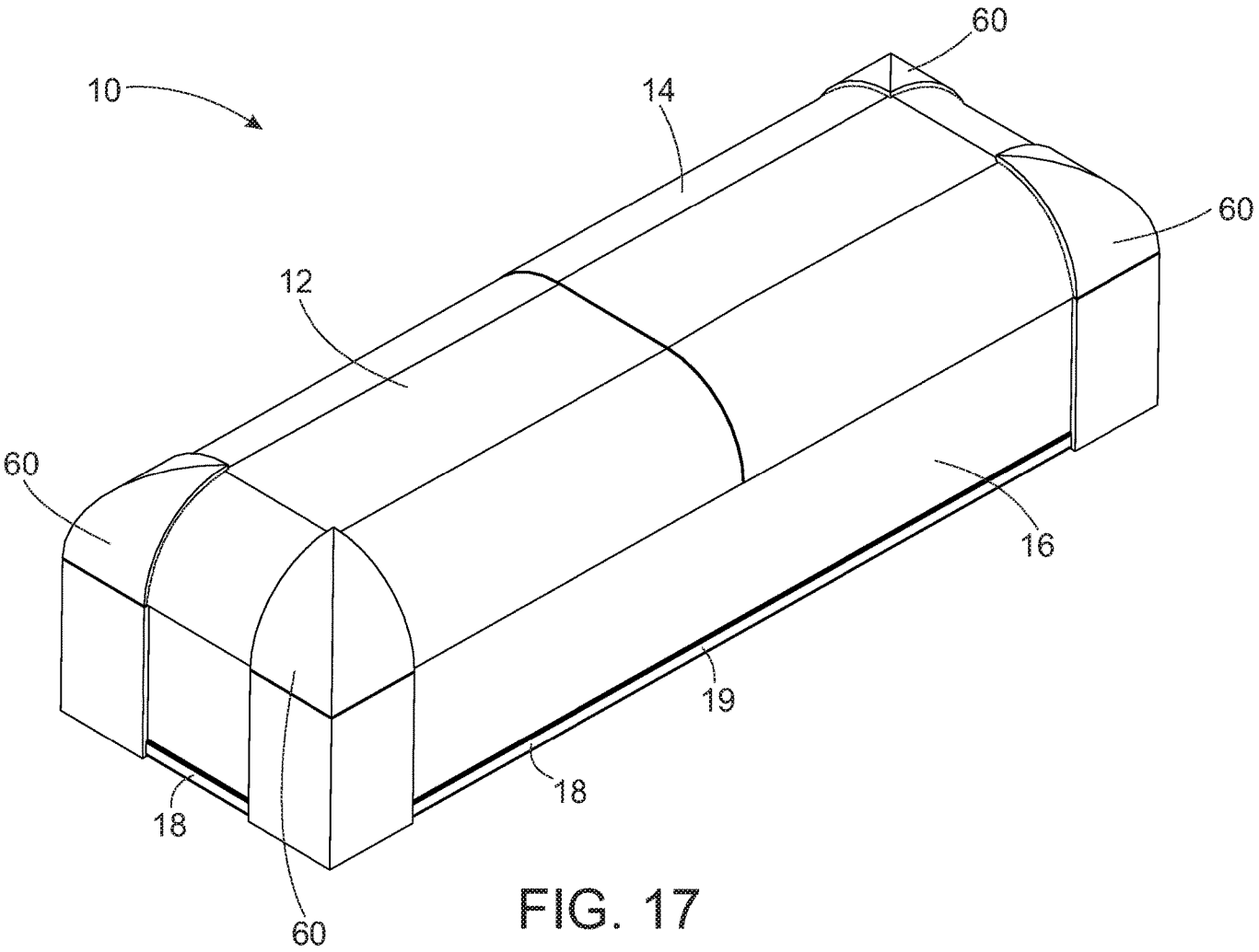
FIG. 17 is an isometric view of an alternate embodiment of a casket with retractable handles in a closed position.

FIGS. 16 and 17 illustrate an alternate embodiment of a casket with retractable handles 10. In these figures, the bars 18 have flat ends that abut corner members 60 when in the closed position.

Corner members 60 are decorative corners that are raised above the original surface of the casket 12. As illustrated, corner members 60 may be rounded or arched. Corner members 60 extend from the top of the lid 14 of the casket 12 to the bottom of the casket box 16. Corner members 60 may be formed in two pieces so that the lid 14 of the casket 12 may still be opened.

Corner members 60 may be any size, shape or style desired to achieve a particular aesthetic for the client.

Alternate embodiments of corner members 60 may include corner members 60 that are only located on the casket box 16 or corner members that are only located on the casket lid 14.

Bars 18 have smooth flat outer surfaces so that when they are in a closed position, the outer surface of the bars 18 are flush with the outer surface of the casket 12 and therefore the bars 18 are disguised and do not appear to be handles.

Having the bars 18 close to a position where their outer surface is flush with the outer surface of the casket 12 allows for increased personalization of the casket 10. If the casket 10 is to be wrapped with images printed on vinyl, the vinyl may be extended to the bars 18 also. This allows the bars 18 to be completely camouflaged when they are in the closed position.

The bars 18 may also have a curved interior surface in order to allow for comfort when the bars 18 are being used to carry the casket 12.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers synthetic and/or natural, woods, glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

What is claimed is:

1. A handle system for use on a casket, the handle system comprising:

a bottom panel;

a plurality of spacers coupled to and abutting said bottom panel, wherein said plurality of spacers and said bottom panel form at least one channel;

at least one arm slidably located in said at least one channel;

at least one bar coupled to said at least one arm;

wherein said at least one arm slides horizontally adjacent at least one of said plurality of spacers causing said at least one bar to retract to a closed position;

a top panel coupled to and abutting said plurality of spacers; and wherein said bottom panel, said plurality of spacers and said top panel form a mostly solid panel wherein said handle system is adapted to be coupled to a bottom of said casket.

2. The handle system of claim 1, wherein said plurality of spacers are flat rectangular members which abut both said top panel and said bottom panel.

3. The handle system of claim 1, wherein said at least one bar is flush with a side of said casket when said at least one bar is in said closed position.

4. The handle system of claim 1, wherein said plurality of spacers further comprise at least one indentation which receives at least one stop coupled to said at least one arm.

5. The handle system of claim 1, wherein said at least one bar further comprises four bars and wherein two of said four bars have a length of between half a width of said casket and a full width of said casket and two more of said four bars have a length of between half a length of said casket and a full length of said casket.

6. The handle system of claim 1, wherein said at least one bar has forty-five degree angled ends so each at least one bar abuts an adjacent at least one bar and causes said at least one bar to appear to be trim on said casket.

7. The handle system of claim 1, wherein a length of said at least one arm is over half a width of casket.

8. The handle system of claim 1, wherein said at least one arm slides horizontally from said closed position to an open position.

9. A casket with retractable handles comprising:

a casket box;

a casket lid openably coupled to said casket box;

a handle system coupled adjacent to a bottom of said casket box;

wherein said handle system further comprises:

at least one bar;

at least two arms coupled to said at least one bar;

wherein said at least two arms are horizontally slidable from a closed location to an open location;

a spacer between said at least two arms;

at least one panel abutting said spacer; and wherein said at least one panel and said spacer form a mostly solid panel with channels substantially the same width as said at least two arms for said at least two arms to slide in.

10. The casket of claim 9, wherein said at least one bar comprises four bars, wherein each one of said four bars is located at each side of said casket box.

11. The casket of claim 9, wherein said at least one bar comprises a 45 degree angle at each end of said at least one bar.

12. The casket of claim 11, wherein said 45 degree angle causes said at least one bar to abut an adjacent at least one bar when in said closed position so as to disguise said at least one bar as trim on said casket box.

13. The casket of claim 9, wherein said at least one bar is between half a length of a side of said casket box and a full length of a side of said casket box said handle system is coupled to.

14. The casket of claim 9, wherein said at least two arms are longer than half a width of said casket box.

15. The casket of claim 9, wherein said at least two arms narrow towards an end farthest away from said at least one bar allowing said at least two arms to overlap other at least two arms when said at least two arms are in a closed position.

16. A casket having retractable handles comprising:

a casket box;

a casket lid openably coupled to said casket box;

a base coupled adjacent to a bottom of said casket box;

wherein said base comprises:

at least one panel comprising a panel length and a panel width, wherein said panel length is between half a length of said casket box and a full length of said casket box and said panel width has a width between half a width of said casket box and a full width of said casket box;

at least one spacer coupled to said at least one panel, wherein said at least one spacer and said at least one panel form channels;

a plurality of arms slidably located in said channels, wherein a width of said channels are substantially the same as a width of said plurality of arms;

at least four bars coupled to said plurality of arms; and wherein sliding said plurality of arms in said channels causes said at least four bars to move from a closed position to an open position.

17. The casket of claim 16, wherein said plurality of arms narrow at an end farthest from said at least four bars allowing a first arm of said plurality of arms to overlap a second arm of said plurality of arms when said at least four bars are in said closed position.

18. The casket of claim 16, wherein said at least four bars move horizontally from said closed position to said open position and from said open position to said closed position.

19. The casket of claim 16, wherein a shape of an outer surface of said at least four bars is the same as a shape of an outer surface of trim on said casket box.

20. The casket of claim 16, wherein said plurality of arms are longer than half said width of said casket box.

* * * * *